United States Patent [19]

Eppy

[11] 4,305,510

[45] Dec. 15, 1981

[54] PHONOGRAPH RECORD HOLDER

[76] Inventor: Marvin Eppy, 1064 River Rd., Edgewater, N.J. 07020

[21] Appl. No.: 89,015

[22] Filed: Oct. 29, 1979

[51] Int. Cl.[3] ..... A47F 7/00

[52] U.S. Cl. ..... 211/40; 211/47; 211/169

[58] Field of Search ..... 211/40, 169, 80, 96, 211/47, 48; 312/10, 14

[56] References Cited

U.S. PATENT DOCUMENTS

| | | | |
|---|---|---|---|
| 1,421,391 | 7/1922 | Bower | 211/40 |
| 1,495,152 | 5/1924 | Becker et al. | 211/40 X |
| 2,804,212 | 8/1957 | Spitzig | 211/40 |
| 3,207,318 | 9/1965 | Gilbert | 211/40 |
| 3,308,960 | 3/1967 | Santori et al. | 312/10 X |
| 3,514,883 | 6/1970 | Albright | 211/169 X |
| 3,570,676 | 3/1971 | Crosslen | 211/169 X |
| 4,232,791 | 11/1980 | Howard | 211/47 |

FOREIGN PATENT DOCUMENTS

| | | | |
|---|---|---|---|
| 2203625 | 8/1972 | Fed. Rep. of Germany | 211/40 |

*Primary Examiner*—Roy D. Frazier
*Assistant Examiner*—Robert W. Gibson, Jr.
*Attorney, Agent, or Firm*—Leo C. Krazinski

[57] ABSTRACT

A phonograph record rack having a framework with upstanding pins for carrying on said pins elongate hinge clamps. The hinge clamps are of one piece extrusion reinforced plastic material being formed of two integral sections, an opening at its spine for mesh engagement with its associated pin and tensioned lips for holding a record album jacket. The hinge clamps are of substantially the same height as the jackets they carry and are adapted to secure in position an arcuate portion of the record itself. It is evident that each of the jackets is disposed in an upright position and can be readily swivelled for identification purposes.

6 Claims, 9 Drawing Figures

12
54
50
52
10
6
20
22
16
26
24
44
28
32
14
3
46
48
30
34
36
38
42
18

PHONOGRAPH RECORD HOLDER

BACKGROUND OF THE INVENTION

The present invention relates to storage of phonograph records and, more particularly, to a rack for carrying a plurality of record album jackets in an upright and swivelled manner.

DESCRIPTION OF PRIOR ART

Phonograph record storage racks are well known, as shown in U.S. Pat. Nos. 2,804,212, 3,207,318, 3,258,126, 3,308,960 and U.S. Pat. No. RE. 27462. Prior attempts to create a record rack that swivels each album left and right have proven too costly to produce because of extensive manufacturing requirements. As a result they have become unmarketable. In such prior art the swivelling action was accomplished by providing the album holder with a pin and the framework with holes to receive the pins, a costly manufacturing process, particularly in the provision of extensive framework containing the holes. Applicant's invention reverses this prior process.

SUMMARY OF THE INVENTION

Accordingly, an object of the present invention is to provide an improved phonograph record storage rack which is not subject to the foregoing difficulties and disadvantages.

Another object of the present invention is to provide an improved phonograph record storage rack that is simple in structure, reliable and inexpensive.

A further object of the invention is to provide an improved phonograph record storage rack that insures retension of the record in the album while being carried in a vertical, swivel position.

Other and further objects will be obvious upon an understanding of the illustrative embodiment about to be described or will be indicated in the appended claims and various advantages not referred to herein will occur to one skilled in the art upon employment of the invention in practice.

In accordance with the present invention, the foregoing objects are generally accomplished by providing a framework having spaced horizontal arms at its base for resting on a flat surface, such as a shelf or table, upstanding spaced pins across the front thereof, and elongate hinge clamps with openings in their spines for mesh engagement with the pins and with tensioned lips opposite the spines for receiving and holding the record album in a vertical, swivel relationship. For heavier duty a framework with depending pins is provided for removable attachment at the upper portion of the above framework, wherein the depending pins are inserted in the openings at the upper portions of the hinge clamp spines.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF PREFERRED EMBODIMENT

Figures 1, 2, 3, 4, 5, 6:
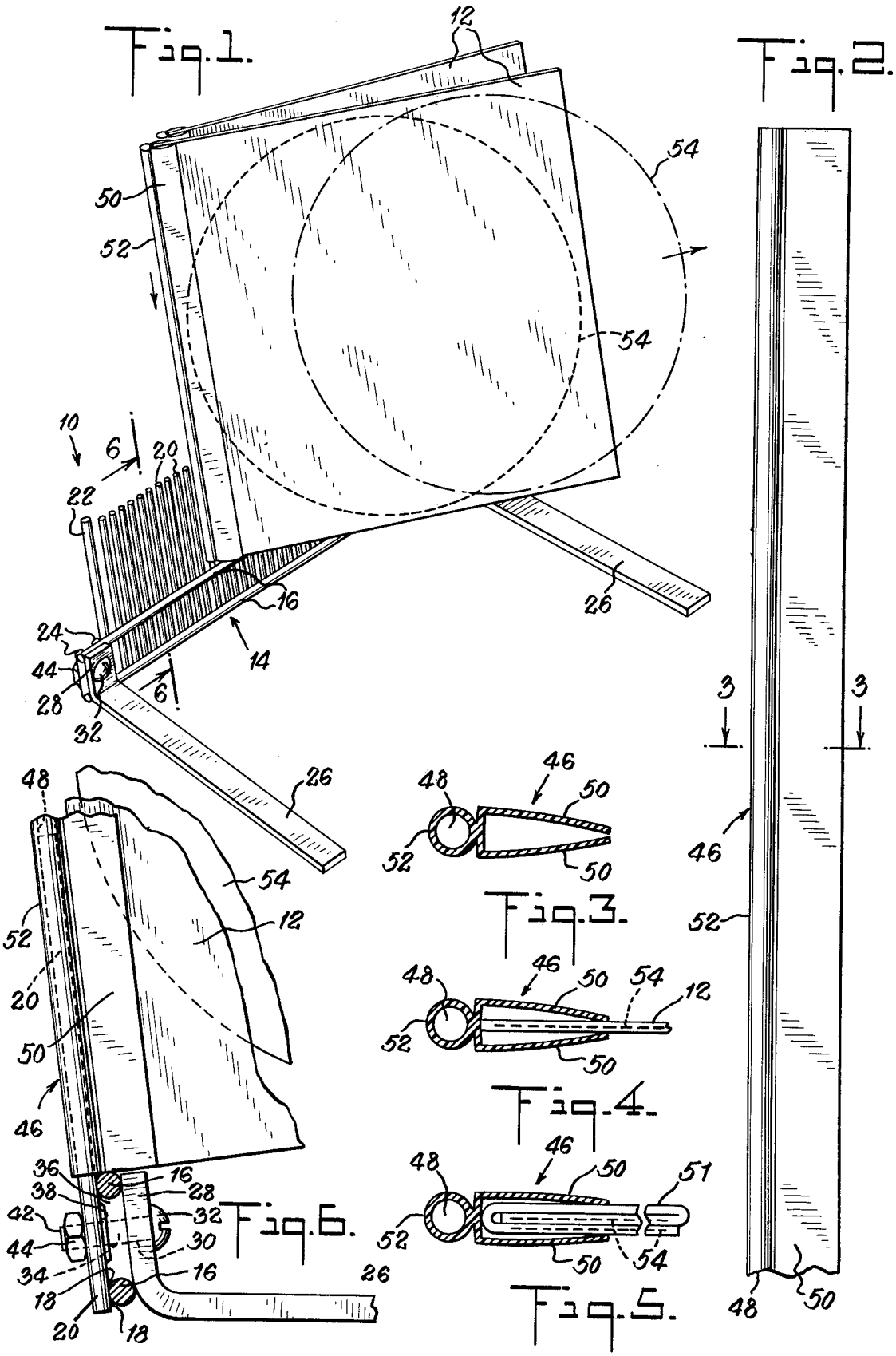
FIG. 1 is a perspective view of a phonograph record storage rack showing a hinge clamp with its elongate spine opening in mesh engagement with the rack pin and with its tensioned lips holding both the record album and an arcuate portion of the record within the album.
FIG. 2 is an elevational view of the hinge clamp shown in FIG. 1.
FIG. 3 is a sectional view taken on line 3—3, in the direction of the arrows, of FIG. 2 showing the hinge clamp per se with the tensional lips in a closed position.
FIG. 4 is a sectional view similar to FIG. 3 showing the spine portion of a record album held by the tensioned lips of the hinge clamp.
FIG. 5 is a sectional view similar to FIG. 4 showing a double sized record album held by the tensioned lips of the hinge clamp.
FIG. 6 is a sectional view taken on line 6—6, in the direction of the arrows, of FIG. 1 showing the structure of a portion of the base of the storage rack.
Figure 7:
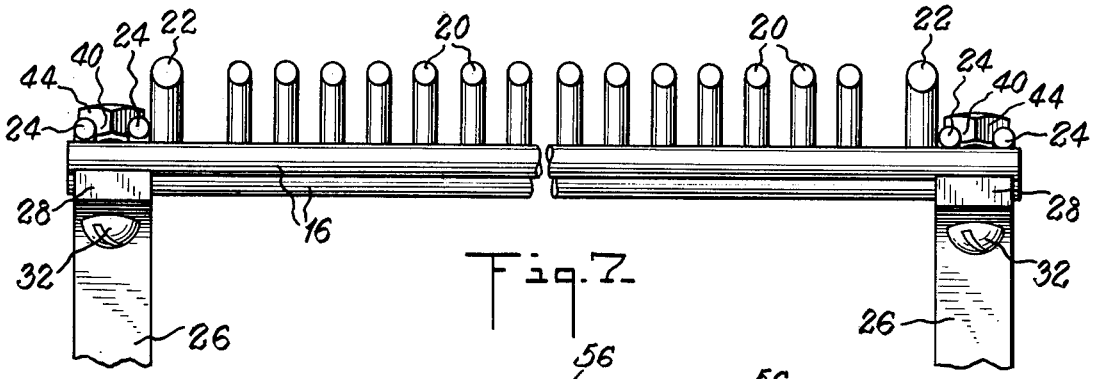
FIG. 7 is a top plan view of the storage rack.

Referring now to the drawings, partiularly to FIGS. 1–7, there is shown a filing means or rack 10 for storing record albums 12 in an upstanding and swivel type relationship. The rack 10 includes a framework 14 having at its base a pair of vertically spaced horizontal rods 16 to which are secured, as by welds 18, upstanding horizontally spaced rods or pins 20 extending across substantially the entire width of the base. The pins 20 are of slightly smaller diameter than those of the horizontal rods 16 and are of a length about one-fourth that of the height of the record album 12. To the right and left, as viewed in FIG. 7, of the end pins 20 are upstanding rods or pins 22, preferably of the same diameter as rods 16, also welded to the rods 16. And at the extreme ends of the base are shown pairs of upstanding pins 24 welded to rods 16. The pins 24 are of the same diameters as those of the pins 20 and are of a length equal to the height of the spaced rods 16. As is evident, the spaced pins 24 function as part of a fastening means for spaced elongate arms 26. Preferably the arms 26 are rectangular in cross section of sufficient length to provide a stable rack and each arm at its inner end has an upstanding element 28 with an opening 30 therethrough. The arms 26 are removably secured to the rods 16, see FIG. 6, by screws 32 having stems 34 passing through openings 30 of the element 28, thence across spaces 36 between the rods 16 through openings in washers 38, which abut pins 24, and finally across spaces 40 between pins 24 after which the ends 42 of the screws 32 are threadedly engaged by nuts 44.

To the framework 14 and particularly to the upstanding pin 20 is shown a telescopically meshed elongate hinge clamp 46 that is of substantially the same length as the height of the record album 12. As seen in FIGS. 3, 4 and 5, the hinge clamp 46 consists of a single piece of strong reinforced plastic material with an elongate opening 48 at its spine for mesh engagement with the upstanding pin 20 and tensioned lips 50 formed integral with and opposite the spine opening 48. The hinge clamp in FIG. 4 shows the tensioned lips 50 securely holding a single record album 12 while in FIG. 5 there is shown a double sized record album 51. Both albums 12 and 51 include records therewithin.

In operation the framework 14 is assembled, as seen in FIG. 1, and the required number of hinge clamps 46 are placed on the pins 20. When an album 12 is to be placed upon a hinge clamp 46, it is preferable to remove the hinge clamp 46 from its associated pin 20. The bottom edges of the tensioned lips 50 are positioned over the top of the album 12, that is, at its spine 52, and with force applied the lips 50 are spread apart to frictionally engage the spine 52. The hinge clamp 46 is next pushed downwardly until the lower edges of the hinge clamp 46 and album spine 50 mesh, meanwhile gripping an arcuate portion of the record 54 within the album 12. The album 12 with its hinge clamp 46 can then be easily dropped over its associated pin 20. It is apparent that the record album 12 when so assembled to the framework 14 can be readily swivelled for observation thereof. It is to be noted that upstanding pins 22 placed at the extreme ends of the framework 14 act as buffers or stops for preventing excessive swivelling motion of the albums 12 placed on the pins 20 next to the pins 22. Albums 12 placed on intermediate pins 20 are buffered by adjacent albums 12 or pins 20 when swivelled.

Figure 8:
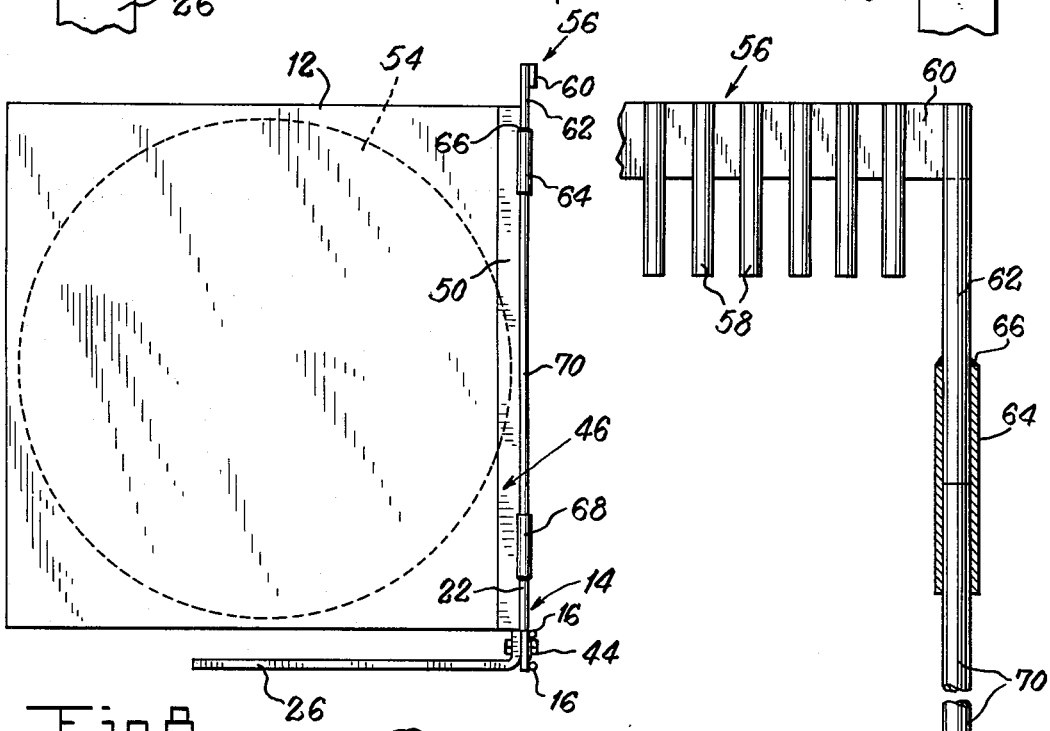
FIG. 8 is a side elevational view of a modified form of the storage rack with top supporting pins on a framework telescopically mounted on the lower framework of the storage rack.
Figure 9:
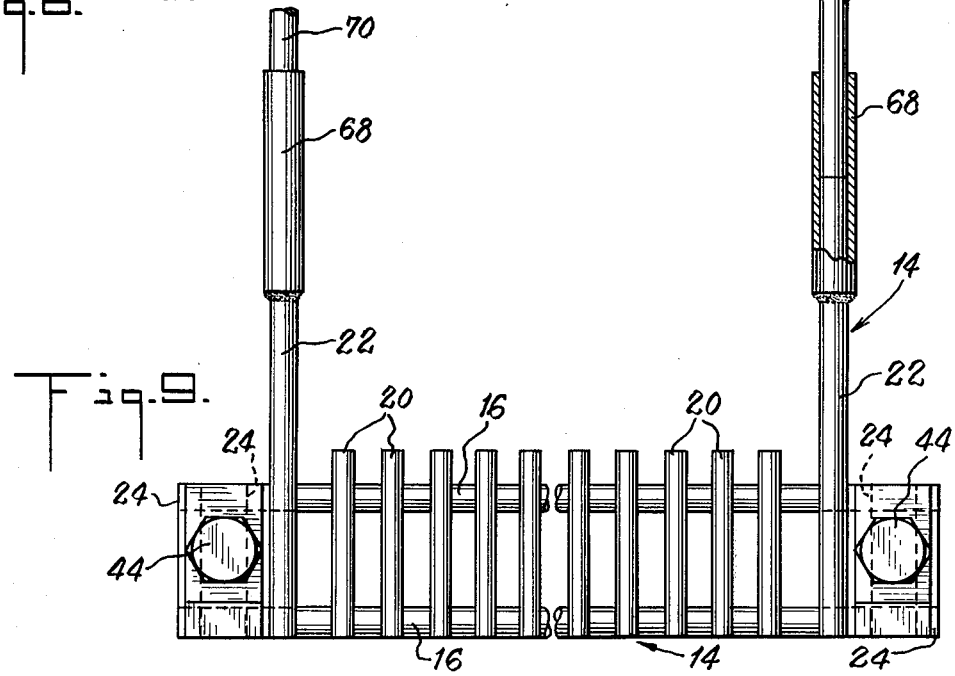
FIG. 9 is a front elevational view of the modified storage rack shown in FIG. 8.

Referring now to FIGS. 8 and 9, there is shown an accessory framework 56 for telescopic addition to the framework 14 in case a stronger structure is required. The framework 56 is similar to the framework 14 in that depending pins 58 are of identical diameters as those of pins 20 and both pins 58 and 20 are adapted to be disposed in alignment for placement thereon of the hinge clamps 46. The pins 58 in this instance are welded to a cross bar 60 and the ends of the cross bar 60 are welded to depending pins 62 that are provided adjacent their lower ends with sleeves 64 secured by welds 66 at the upper ends of the sleeves 64. The pins 62 are of the same diameter as those of pins 22. Sleeves 68 are also secured adjacent the upper ends of pins 22. Both sleeves 64 and 68 are shown in alignment for reception therein of interconnecting pins 70 for both frameworks 14 and 56.

In operation, both frameworks 14 and 56 are interconnected by first dropping interconnecting pins 70 into sleeves 68 after which the sleeves 64 of framework 14 are dropped in mesh engagement with the upper ends of interconnecting pins 70, as seen in FIG. 9. Since pins 20 and 58 are in opposite alignment and since the overall length of the hinge clamp 46 is greater than the distance between the free ends of the pins 20 and 58, the upper end of the hinge clamp 46 is first pushed up into the pin 58 a short distance until its lower end is clear of the upper end of the pin 20 and then dropped into pin 20, after which the hinge clamp 46 with its record album 12 is swivelling disposed on the frameworks 14 and 56.

From the foregoing description, it will be seen that the present invention provides a phonograph record holder that is simple to manufacture, economical in cost and enhances the appearance of album holders.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A rack or file for supporting phonograph record albums comprising, in combination, a first framework, a row of horizontally spaced vertical pins on said framework, a pair of vertically spaced horizontal rods across said framework, a pair of horizontally spaced vertical pins at each end of said rods, means for rigidly securing said pairs of pins to said rods to provide a rigid structure, an elongate arm at each end of said rods and at substantially right angles to said rods, an upstanding element at an inner end of each of said arms, means for removably securing each of said upstanding elements to each of said pairs of pins and to said rods, means for rigidly securing said row of horizontally spaced vertical pins to said rods, and an elongate hinge clamp for carrying each of said albums, said hinge clamp at its spine having an elongate, longitudinal opening for mesh engagement with said first mentioned pins, elongate tensioned lips on said hinge clamp opposite said spine for gripping and holding said albums with records therein, whereby said albums may be swivelled for identification purposes.

2. A rack in accordance with claim 1, wherein said removably securing means comprise a nut, washer and bolt combination, wherein the upstanding element has a transverse opening therethrough, and a stem on said bolt passes through said transverse opening, through a space between said horizontal rods, through an opening in said washer, through and beyond a space between said pair of horizontally spaced pins, whereby said nut is threadly engageable with an end of the bolt stem.

3. A rack in accordance with claim 1, wherein said hinge clamp consists of a single elongate body of reinforced plastic material formed with a head or spine having said elongate opening, a neck portion, and a pair of embracingly resilient arms or said lips having their free ends tensioned to substantially engage each other, said lips and spine being inter connected by said neck portion.

4. A rack in accordance with claim 1, wherein a buffer pin is provided adjacent each side of said row of horizontally spaced vertical pins.

5. A rack in accordance with claim 4, including a first sleeve at the free end of each of said buffer pins, means for rigidly securing one end of each of said sleeves to each of said buffer pins, a second framework superimposed upon said first framework, said second framework comprising a cross-bar, a depending pin at each end of said cross-bar, means for rigidly securing one end of said depending pin to said cross-bar, a second sleeve at the other end of each of said depending pins, means for rigidly securing one end of each of said second sleeves to each of said depending pins, a row of horizontally spaced depending pins on said cross-bar, means for rigidly securing said row of horizontally spaced depending pins to said cross-bar, and an interconnecting pin in mesh engagement with each of said first and second sleeves.

6. A rack in accordance with claim 5, wherein the free ends of said depending pins and upstanding pins, said row of horizontally depending pins and said row of horizontally spaced vertical pins, and said first and second sleeves, are all in alignment, whereby said albums may be carried by said depending and vertical pins.

* * * * *